United States Patent [19]

Johnson

[11] Patent Number: 4,759,738

[45] Date of Patent: Jul. 26, 1988

[54] FLOATING CUSHION SUB

[75] Inventor: Clarence W. Johnson, Calgary, Canada

[73] Assignee: Bralorne Resources Limited, Calgary, Canada

[21] Appl. No.: 740,370

[22] Filed: Jun. 3, 1985

[30] Foreign Application Priority Data

Jun. 1, 1984 [CA] Canada ..... 455651

[51] Int. Cl.[4] ..... E21B 17/02; F16F 15/10

[52] U.S. Cl. ..... 464/20; 175/321; 267/137

[58] Field of Search ..... 175/321; 267/124, 125, 267/137; 464/18, 20, 21, 162, 180

[56] References Cited

U.S. PATENT DOCUMENTS

| | | | |
|---|---|---|---|
| 3,779,040 | 12/1973 | Garrett | 464/20 |
| 3,947,009 | 3/1976 | Nelmark | 464/20 X |
| 4,145,034 | 3/1979 | Dyer | 175/321 X |
| 4,192,155 | 3/1980 | Gray | 464/20 |

FOREIGN PATENT DOCUMENTS

| | | | |
|---|---|---|---|
| 347428 | 8/1972 | U.S.S.R. | 175/321 |
| 578425 | 10/1977 | U.S.S.R. | 175/321 |
| 697683 | 11/1979 | U.S.S.R. | 175/321 |

*Primary Examiner*—Daniel P. Stodola
*Attorney, Agent, or Firm*—John R. Uren

[57] ABSTRACT

A floating cushion connection member is operable between a power head and a drill string member. A first cap member is mounted about the periphery of a piston. A washpipe extends from within the bore of the piston to a mounting area in a second cap member. A body member connects the first and second cap members. A spline member in the form of drive pins located between the body member and the piston rotate the piston with the body member and second cap member and allow the piston to move axially relative to the body member and the second cap member. The washpipe has limited angular movement within the second cap member and the piston. Cushion members are provided between the second cap member and the piston and the piston and the first cap member, respectively.

9 Claims, 4 Drawing Sheets

FLOATING CUSHION SUB

INTRODUCTION

This application relates to an improved floating cushion connection member for use on drill rigs.

BACKGROUND OF THE INVENTION

U.S. Pat. No. 4,192,155 (Gray), granted to the applicant, discloses a floating cushion connection member which has been in satisfactory use for a number of years. This connection member is used between the power head and the uppermost piece of drill pipe when connecting and disconnecting drill pipe in the drill string. Such use prevents jamming, premature wear on the threaded connections between pipe members and abrupt load transfers.

There are, however, areas of the cushion connection member which have caused problems. One area relates to the use of the washpipe extension on the piston. The washpipe extension extends axially from the piston into the bore of the outer housing shown as a pin connection. While theoretically there should be no angular movement between the two ends of the connection member, in practice with wear and continuing use, this is not so. A moment is periodically applied to the washpipe extension which results in stress fractures where it joins the piston.

A further problem relates to the bore diameter of the pin end of the connection member. In the connection member disclosed in aforementioned U.S. Pat. No. 4,192,155, the washpipe extension is received in the bore of the pin end which, therefore, dictates a bore diameter in the pin connection member which may be smaller than desired for strength and fluid flow purposes.

Yet a further problem relates to the use of the cushion material in the connection member. The cushion material in the member of aforementioned U.S. Pat. No. 4,192,155 does not entirely fill the cavity. This leads to shear problems when axial force is applied and, additionally, the cushion member does not contribute to the desired stiffness in the connection member when loading the drill bit.

Yet a further problem relates to the length of the member disclosed in aforementioned U.S. Pat. No. 4,192,155. It is desirable, because of the restricted distance between the drill head and the uppermost piece of drill pipe, to have a connection member with as short a length as possible. The washpipe extending from the piston limits the length reduction.

SUMMARY OF THE INVENTION

According to the present invention, there is disclosed a connection member operable to be used between a power head and a drill string member comprising a piston, a first cap member mounted above the periphery of said piston, a second cap member, a body member connecting said first and second cap members, spline means between said body and said piston to allow longitudinal movement of said piston relative to said body member, a washpipe extending from said second cap member into said piston, said washpipe having limited angular movement relative to said piston and said second cap member, said washpipe being longitudinally moveable relative to said piston, first and second connection means on said piston and second cap members operable to connect said piston and said second cap member to one of said drill string and power head.

BRIEF DESCRIPTION OF THE SEVERAL VIEWS OF THE DRAWINGS

An embodiment of the invention will now be described, by way of example only, with the use of drawings in which.

DESCRIPTION OF SPECIFIC EMBODIMENT

Figure 1:
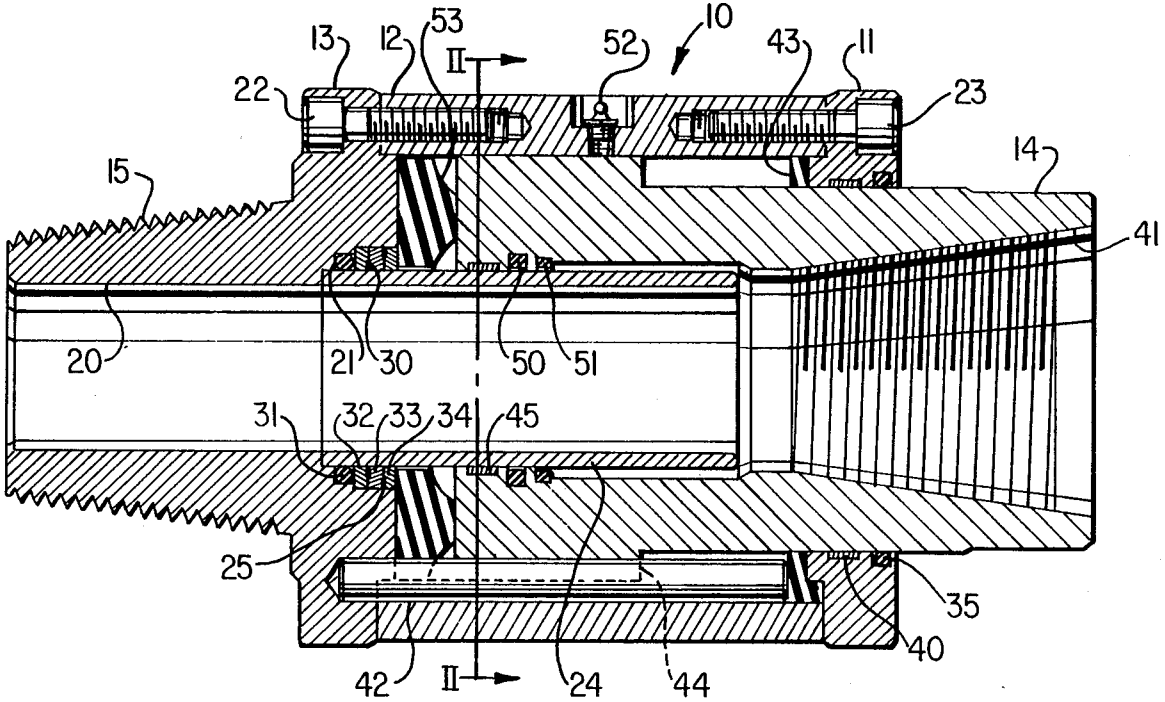
FIG. 1 is a cross-sectional view of the connection member.

Referring now to the drawings, a floating cushion connection member is shown generally at 10 in FIG. 1. It comprises a first cap member 11, a body member 12 and a second cap member 13. A piston 14 is encircled by the first cap member 11 and extends inwardly within the connection member 10.

Figure 2:
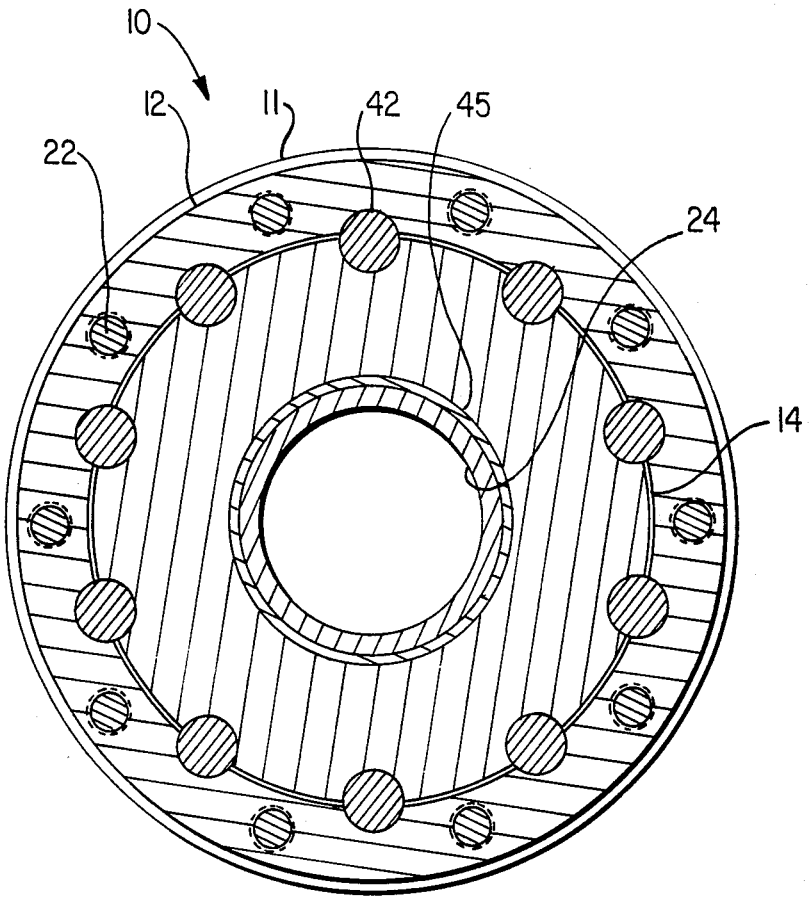
FIG. 2 is a cross-sectional view taken along the line II—II of FIG. 1

Second cap member 13 has connection means, namely a pin connection 15 and a first and second interior bore 20, 21, respectively. Second cap member 13 is connected to body member 12 by aseries of peripherally located cap screws 22 as also seen in FIG. 2. First cap member 11 is also connected to body member 12 by a series of peripherally located cap screws 23. A washpipe 24 is mounted in second interior bore 21 and is retained in position therein by retaining rings 25, 30. A U-cup and expander seal 31 is mounted around the end of washpipe 24 and three washers 32, 33 and 34 act between the retaining rings 25, 30 respectively.

Piston 14 extends through first cap member 11 and into the connection member 10. A combined wiper and seal 35 acts between the first cap member 11 and piston 14 to retain lubricant within body member 12 and to prevent foreign material being carried into the interior of the connection member 10 which could be caused by the reciprocal movement of piston 14. A non-metallic wear ring 40 is also mounted around first cap member 11.

Piston 14 has a first connection means, namely box connection 41 adapted for connection to the pin end on a piece of drill pipe (not shown).

Drive pins 42 are positioned within second cap member 13 and extend to a first cushion member 43. They act as a dowel pin connection to transmit torque between second cap member 13 and body member 12 and as a splined connection 44 between the piston 14 and body member 12, as seen more clearly in FIG. 2, and allow longitudinal relative movement between the piston 14 and body member 12.

A wear ring 45, a U-cup and expander seal 50 and a wiper 51 act between the washpipe 24 and the piston 14.

A grease nipple 52 is mounted in body member 12 and allows grease to be supplied to lubricate the splined connection 44.

Resilient first and second cushion members 43, 53 are mounted within the connection member 10. Second cushion member 53 is mounted around the periphery of washpipe 24 and extends radially outwardly to the inside diameter of body member 12 allowing recesses for the drive pins 42. First cushion member 43 is mounted around piston 14 and extends outwardly into the drive pin recesses in body member 12. Second cushion member 53 is shaped so as to provide increasing stiffness as piston 14 moves towards the second cap member 13.

OPERATION

In operation, the pin connection 15 of the second cap member 13 is connected to the power head in a drill rig (not shown) and, thereafter, it reciprocally moves with the power head. The box connection 41 of the piston 14 will be threaded onto the drill pipe in the drill string. The splined connection 44 permits free axial movement of the piston 14 relative to the body member 12 and, therefore, the threads on the first or box connection means 41 of the piston 14 can mate with corresponding threads on the drill pipe and reduce the possibility of jamming the threads during initial assembly.

The cushion members 43, 53 serve to reduce shocks or vibration transmitted by the drill string to the power head. To that end, when the connection is made between the drill pipe and the box connection 41, the second cushion member 53 provides a resilient pressure on piston 14 and cushions any vibrations transmitted from the bit by the drill string. A more consistent load on the bit is applied thus improving bit penetration on high and low parts of each bit revolution. As the second cushion member 53 is compressed by piston 14, the force acting on piston 14 increases. Thus, the movement of the piston 14 in the connection member is restricted and, as well, vibrations are dampened. Similarly, in "hold back" drilling, first cushion member 43 provides the resilient cushioning and the same benefits including the dampening effect on piston 14.

Figure 3:
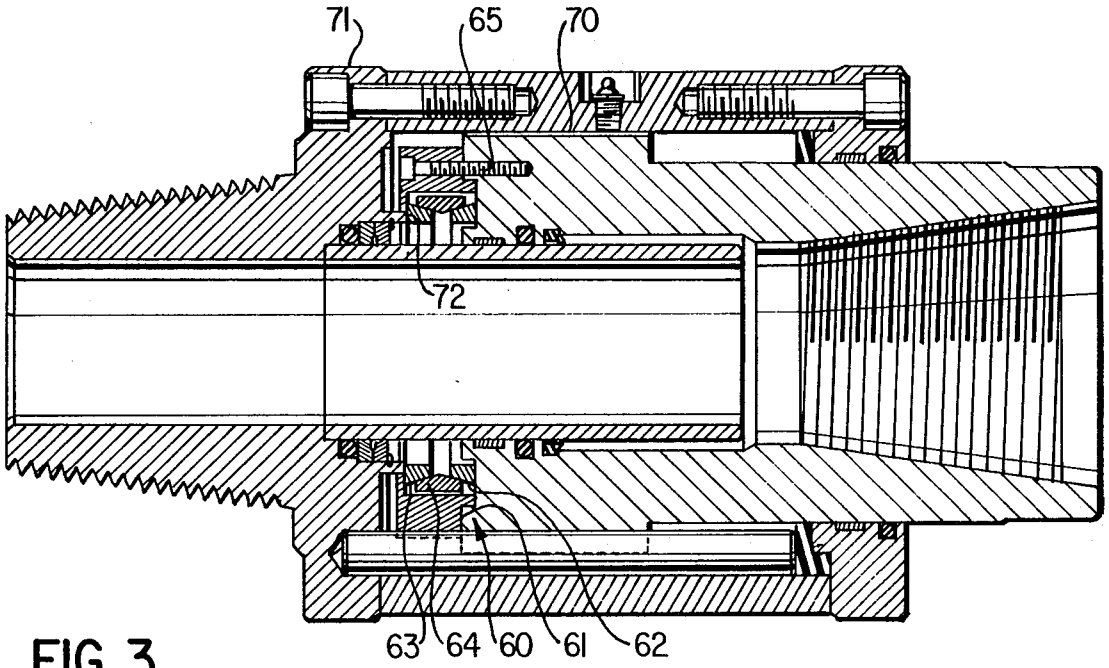
FIG. 3 is a cross-sectional view of the connection member similar to FIG. 1 but of a second embodiment.

A second embodiment of the invention is depicted in FIG. 3. This embodiment is identical to the FIG. 1 embodiment except that the second cushion member 53 is replaced by a combination retainer-friction spring combination generally shown at 60.

Retainer-friction spring 60 comprises a retainer 61, first and second internal friction spring rings 62, 63, respectively and external friction spring ring 64. Cap screws 65 connect the retainer 61 and spring rings 62, 63 to the piston 70. Second cap member 71 is formed with a circumferential abutment 72 which contacts and restrains movement of the second internal friction spring ring 63.

In operation, the embodiment depicted in FIG. 3 acts identically to the FIG. 1 embodiment until the spring ring 63 contacts the circumferential abutment 72. The wedge action between the spring rings 62, 63 will act to force the external spring ring 64 outwardly and to force the internal spring rings 62, 63 inwardly. This movement provides a cushioning effect as the spring rings 62, 63, 64 interact. It is noted that the retainer-friction spring combination 60 is designed such that the spring rings 62, 63 will contact and, therefore, stop further compressive movement before the elastic limit of the spring ring material is reached.

The use of the retainer-spring combination 60 is particularly advantageous when high temperature drilling conditions are encountered when rubber cushioning material would be subject to rapid deterioration. It has also been found that the friction and vibration dampening characteristics are much improved over the rubber material.

Figure 4:
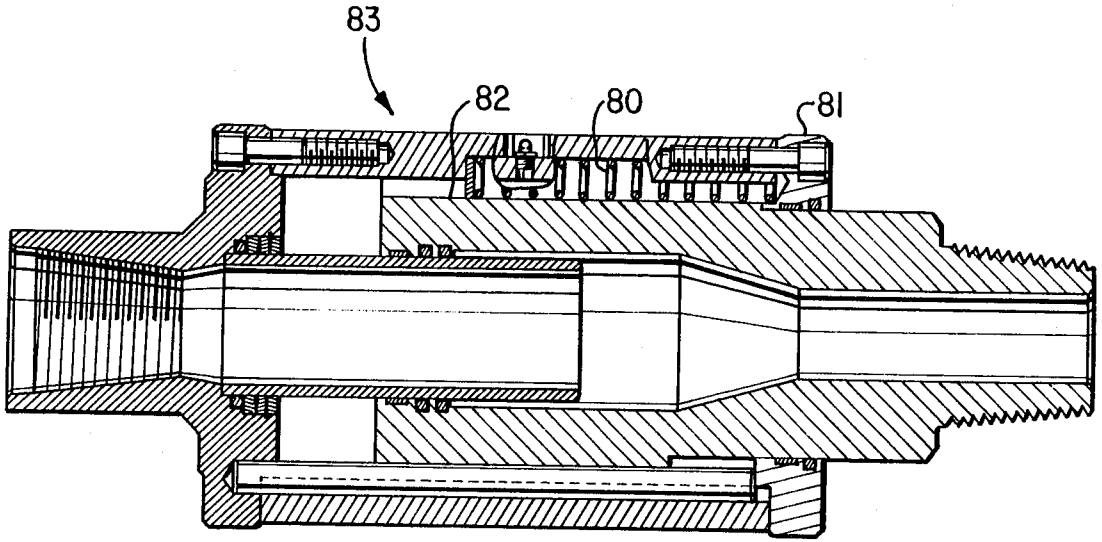
FIG. 4 is a cross-sectional view of the connection member similar to FIGS. 1 and 3 but of yet a third embodiment.

A third embodiment is depicted in FIG. 4. In this embodiment, either the second cushion member 53 of the FIG. 1 embodiment or the retainer-friction spring 60 of the FIG. 3 embodiment may be used and, for that reason, neither is shown. However, some drive pins 42 of the splined connection 44 of the FIG. 1 embodiment are replaced with a series of compression springs 80 which are mounted between first cap member 81 and piston 82.

The compression springs 80 are constructed with a spring rate such that the weight of a drill string member suspended from the threaded end of piston 82 will be supported with the springs compressed to approximately mid stroke. Thus the weight of the drill string member does not rest on the threads of the lower drill string member while the threads are being engaged or disengaged. This minimizes jamming and reduces wear on the drill string thread flanks.

Other changes presently contemplated are, of course, that the cushion connection member 83 can have two pin connections, two box connections or a pin and an opposed box connection located at either end of the cushion member.

Various other modifications may be made in the specific apparatus described without departing from the scope of the invention as defined in the accompanying claims.

I claim:

1. A connection member operable to be used between a power head and a drill string member comprising a piston, a first cap member mounted about the periphery of said piston, a second cap member, a body member connecting said first and second cap members, spline means between said body member and said piston relative to said body member, a washpipe extending from said second cap member into said piston, said washpipe being operable to have limited angular movement relative to both of said piston and said second cap member, said piston further being longitudinally movable relative to said washpipe, said first and second cap members being operable to connect said piston and said second cap member to one of said drill string and power head.

2. A connection member as in claim 1 and further comprising a first cushion member within said body member and adjacent said first cap member.

3. A connection member as in claim 2 wherein said first cushion member is rubber.

4. A connection member as in claim 2 wherein said first cushion member comprises a compression spring.

5. A connection member as in claim 2 and further comprising a second cushion member within said body between said second cap member and said piston.

6. A connection member as in claim 5 wherein said second cushion member comprises friction spring rings.

7. A connection member as in claim 5 wherein said second cushion member is rubber material.

8. A connection member as in claim 5 wherein said first and second cap members and said body member are separate connected pieces.

9. A connection member as in claim 8 wherein said washpipe is retained in said second cap member by a retaining ring.

* * * * *

UNITED STATES PATENT AND TRADEMARK OFFICE

CERTIFICATE OF CORRECTION

PATENT NO. : 4,759,738

DATED : July 26, 1988

INVENTOR(S) : Johnson, Clarence W.

It is certified that error appears in the above-identified patent and that said Letters Patent is hereby corrected as shown below:

In the Claims:

Claim 1, line 6 (Column 4, line 36), after "piston" add --to allow longitudinal movement of said piston--

Signed and Sealed this

Eighth Day of October, 1991

*Attest:*

HARRY F. MANBECK, JR.

*Attesting Officer*

*Commissioner of Patents and Trademarks*